US006971350B2

(12) United States Patent
Akasaka et al.

(10) Patent No.: US 6,971,350 B2
(45) Date of Patent: Dec. 6, 2005

(54) VARIABLE VALVE CONTROL SYSTEM FOR INTERNAL COMBUSTION ENGINE

(75) Inventors: Yuuzou Akasaka, Yokohama (JP); Tsuneyasu Nohara, Kanagawa (JP); Katsuhiko Kawamura, Yokohama (JP); Hajime Miura, Tokyo (JP); Satoshi Nishii, Kawasaki (JP)

(73) Assignee: Nissan Motor Co., Ltd., Yokohama (JP)

( * ) Notice: Subject to any disclaimer, the term of this patent is extended or adjusted under 35 U.S.C. 154(b) by 8 days.

(21) Appl. No.: 11/065,450

(22) Filed: Feb. 25, 2005

(65) Prior Publication Data

US 2005/0188931 A1 Sep. 1, 2005

(30) Foreign Application Priority Data

Feb. 26, 2004 (JP) ..... 2004-050976

(51) Int. Cl.[7] ..... F01L 1/34

(52) U.S. Cl. ..... 123/90.16; 123/90.15; 123/90.31

(58) Field of Search ..... 123/90.15, 90.16, 123/90.17, 90.31

(56) References Cited

U.S. PATENT DOCUMENTS 6,390,041 B2 5/2002 Nakamura et al.
6,810,844 B2 * 11/2004 Sellnau ..... 123/90.16

FOREIGN PATENT DOCUMENTS

JP 2001-173469 A 6/2001
JP 2002-89341 A 3/2002

* cited by examiner

*Primary Examiner*—Thomas Denion
*Assistant Examiner*—Zelalem Eshete
(74) *Attorney, Agent, or Firm*—Foley and Lardner

(57) ABSTRACT

A variable valve control system for an internal combustion engine including a plurality of cylinders, the variable valve control system including a variable lift characteristic control mechanism to adjust a valve lift characteristic of each of intake valves. The variable valve control system is configured to perform determining an engine condition indicator in correlation with an actual relative variation in the valve lift characteristic between the cylinders; determining a desired valve lift characteristic in accordance with an operating condition of the internal combustion engine; controlling the valve lift characteristic of each of the intake valves in accordance with the desired valve lift characteristic; determining the engine condition indicator when the desired valve lift characteristic is equal to a predetermined small valve lift characteristic setting; and expanding the small valve lift characteristic setting if the determined engine condition indicator is larger than a predetermined first threshold value.

21 Claims, 8 Drawing Sheets

ROCKABLE CAM 60
AT MINIMUM DISPLACEMENT

VALVE LIFT:
ZERO

ROCKABLE CAM 60
AT MAXIMUM DISPLACEMENT

ROCKABLE CAM 60
AT MINIMUM DISPLACEMENT

VALVE LIFT:
MAXIMUM

ROCKABLE CAM 60
AT MAXIMUM DISPLACEMENT

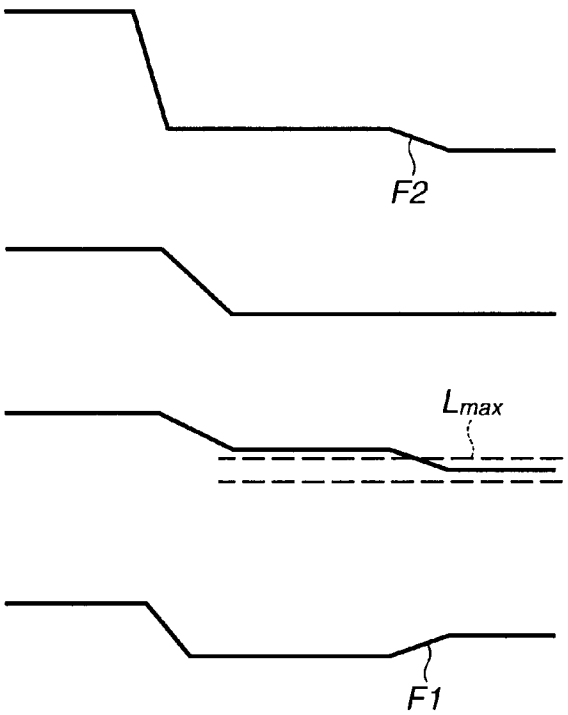
FIG.7A
FIG.7B
FIG.7C
FIG.7D
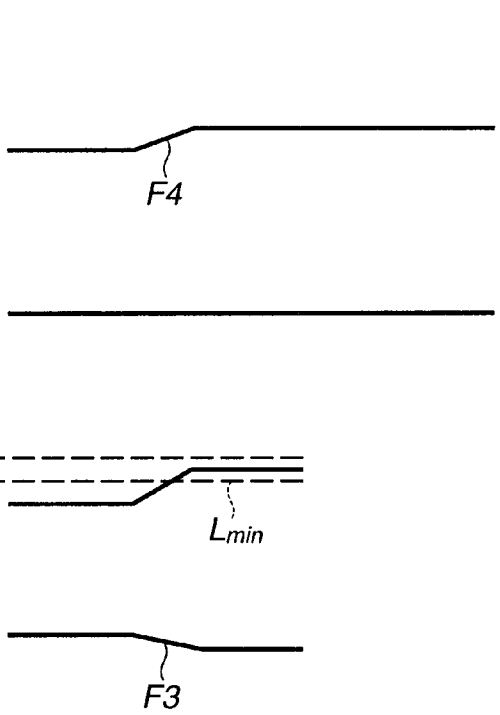
FIG.8A
FIG.8B
FIG.8C
FIG.8D

VARIABLE VALVE CONTROL SYSTEM FOR INTERNAL COMBUSTION ENGINE

BACKGROUND OF THE INVENTION

The present invention relates generally to variable valve control systems for internal combustion engines which are capable of continuously varying a lift and a working angle of an intake valve, and more particularly to a variable valve control system for an internal combustion engine which employs a variable lift and working angle control mechanism to continuously vary a lift and a working angle of an intake valve.

In recent years, there have been proposed and developed various variable valve control systems enabling both a working angle (an operating angle) and a phase to be varied for a high degree of freedom of valve lift characteristics and enhanced engine performance through all engine operating conditions. Such a variable valve control system has been disclosed in Japanese Patent Provisional Publication No. 2001-173469 (hereinafter is referred to as "JP2001-173469"). In the system disclosed in JP2001-173469, a variable lift and working angle control mechanism is provided to continuously expand or contract a valve lift and a working angle of an intake valve, and a variable phase control mechanism is provided to retard or advance the angular phase at the maximum intake-valve lift point (often called "central-angle phase"). Such a variable valve control system is capable of controlling the quantity of intake air flowing into a combustion chamber of each of the cylinders without the control of the opening of a throttle valve. During the engine operating under low-load conditions in which the quantity of intake air needs to be small, the quantity of intake air is reduced by contracting the intake-valve lift characteristic with the throttle opening held fully open or large. This throttleless operation of the engine largely reduces the pumping loss of the engine.

SUMMARY OF THE INVENTION

With the above-mentioned variable valve control system including the variable lift and working angle control mechanism in JP2001-173469, the valve lift (maximum valve lift) of each of the intake valves is adjusted to be an ultrasmall value such as 1 mm as a minimum valve lift setting, to provide an ultrasmall quantity of intake air which is desired in low-load conditions such as an idle condition. If the intake-valve lift varies from cylinder to cylinder during the intake-valve lift being ultrasmall, the variation causes a relatively large variation in the intake air quantity between the cylinders. This causes a large relative variation in the air fuel ratio between the cylinders. Increasing the minimum valve lift setting to prevent a large relative variation in air fuel ratio between the cylinders reduces advantages of the variable control system, for example, an advantage of the reduction of pumping loss, and an advantage of the enhancement of a response of acceleration from idle conditions.

In the system of JP2001-173469, as shown in paragraph [0074] of JP2001-173469, during the engine operating in low-load conditions such as an idle condition, the valve lift of each of the intake valves is adjusted to be zero or a predetermined small valve lift setting. The small lift setting is produced by multiplying a valve clearance and two or more, so that the variation or error of the intake-valve lift does not cause the above-mentioned problems. More specifically, the valve lift of a specific part of the cylinders is adjusted to be zero, while the valve lift of the other cylinders is adjusted to be the small valve lift setting. This control needs an intricate valve mechanism to provide different valve lift characteristics between the specific part of the cylinders and the other cylinders, resulting in degradation in the mountability of the variable valve control mechanism to the engine and in an increase of the cost. In addition, initially setting the small valve lift setting in accordance with an initial condition of the cylinder-to-cylinder variation in the intake-valve lift which is dependent on the tolerance of the constituent parts and the tolerance of assembly of the parts is not enough to provide a proper small valve lift characteristic, in consideration of secular change in the variation in the intake-valve lift among the cylinders, which is, for example, produced by the accumulation of carbon and deposit.

Accordingly, it is an object of the present invention to provide a variable valve control system for an internal combustion engine including a plurality of cylinders, which is capable of continuously varying a lift and a working angle of each of intake valves with no undesired phenomenon caused by relative variation in the intake-valve lift characteristic between the cylinders during the engine operating with the minimum intake-valve lift characteristic setting.

According to one aspect of the present invention, a variable valve control system for an internal combustion engine including a plurality of cylinders and a plurality of intake valves each for an associated one of the cylinders comprises: a variable lift characteristic control mechanism to adjust a valve lift characteristic of each of the intake valves; a sensing section to collect information needed to determine an engine condition indicator in correlation with an actual relative variation in the valve lift characteristic between the cylinders; and a control unit in operative communication with the variable lift characteristic control mechanism and the sensing section, to perform the following: determining a desired valve lift characteristic in accordance with an operating condition of the internal combustion engine; controlling the valve lift characteristic of each of the intake valves in accordance with the desired valve lift characteristic; determining the engine condition indicator when the desired valve lift characteristic is equal to a predetermined small valve lift characteristic setting; and expanding the small valve lift characteristic setting if the determined engine condition indicator is larger than a predetermined first threshold value.

According to another aspect of the invention, a variable valve control system for an internal combustion engine including a plurality of cylinders and a plurality of intake valves each for an associated one of the cylinders comprises: variable lift characteristic control means for adjusting a valve lift characteristic of each of the intake valves; sensing means for collecting information needed to determine an engine condition indicator in correlation with an actual relative variation in the valve lift characteristic between the cylinders; and control means in operative communication with the variable lift characteristic control means and the sensing means for performing the following: determining a desired valve lift characteristic in accordance with an operating condition of the internal combustion engine; controlling the valve lift characteristic of each of the intake valves in accordance with the desired valve lift characteristic; determining the engine condition indicator when the desired valve lift characteristic is equal to a predetermined small valve lift characteristic setting; and expanding the small valve lift characteristic setting if the determined engine condition indicator is larger than a predetermined first threshold value.

According to a further aspect of the invention, a method of controlling a variable valve control system for an internal combustion engine including a plurality of cylinders and a plurality of intake valves each for an associated one of the cylinders, the variable valve control system including a variable lift characteristic control mechanism to adjust a valve lift characteristic of each of the intake valves, comprises: determining an engine condition indicator in correlation with an actual relative variation in the valve lift characteristic between the cylinders; determining a desired valve lift characteristic in accordance with an operating condition of the internal combustion engine; controlling the valve lift characteristic of each of the intake valves in accordance with the desired valve lift characteristic; determining the engine condition indicator when the desired valve lift characteristic is equal to a predetermined small valve lift characteristic setting; and expanding the small valve lift characteristic setting if the determined engine condition indicator is larger than a predetermined first threshold value.

The above objects and other objects, features, and advantages of the present invention are readily apparent from the following detailed description of the best modes for carrying out the invention when taken in connection with the accompanying drawings.

BRIEF DESCRIPTION OF THE DRAWINGS

FIG. 7A is a time chart depicting a change in the throttle opening in the process of FIG. 6.

FIG. 7B is a time chart depicting a change in the engine speed in the process of FIG. 6.

FIG. 7C is a time chart depicting a change in the level of engine vibration in the process of FIG. 6.

FIG. 7D is a time chart depicting a change in the intake-valve lift in the process of FIG. 6.

FIG. 8A is a time chart depicting a change in the throttle opening in the process of FIG. 6.

FIG. 8B is a time chart depicting a change in the engine speed in the process of FIG. 6.

FIG. 8C is a time chart depicting a change in the level of engine vibration in the process of FIG. 6.

FIG. 8D is a time chart depicting a change in the intake-valve lift in the process of FIG. 6.

DETAILED DESCRIPTION OF THE INVENTION

Figure 1:
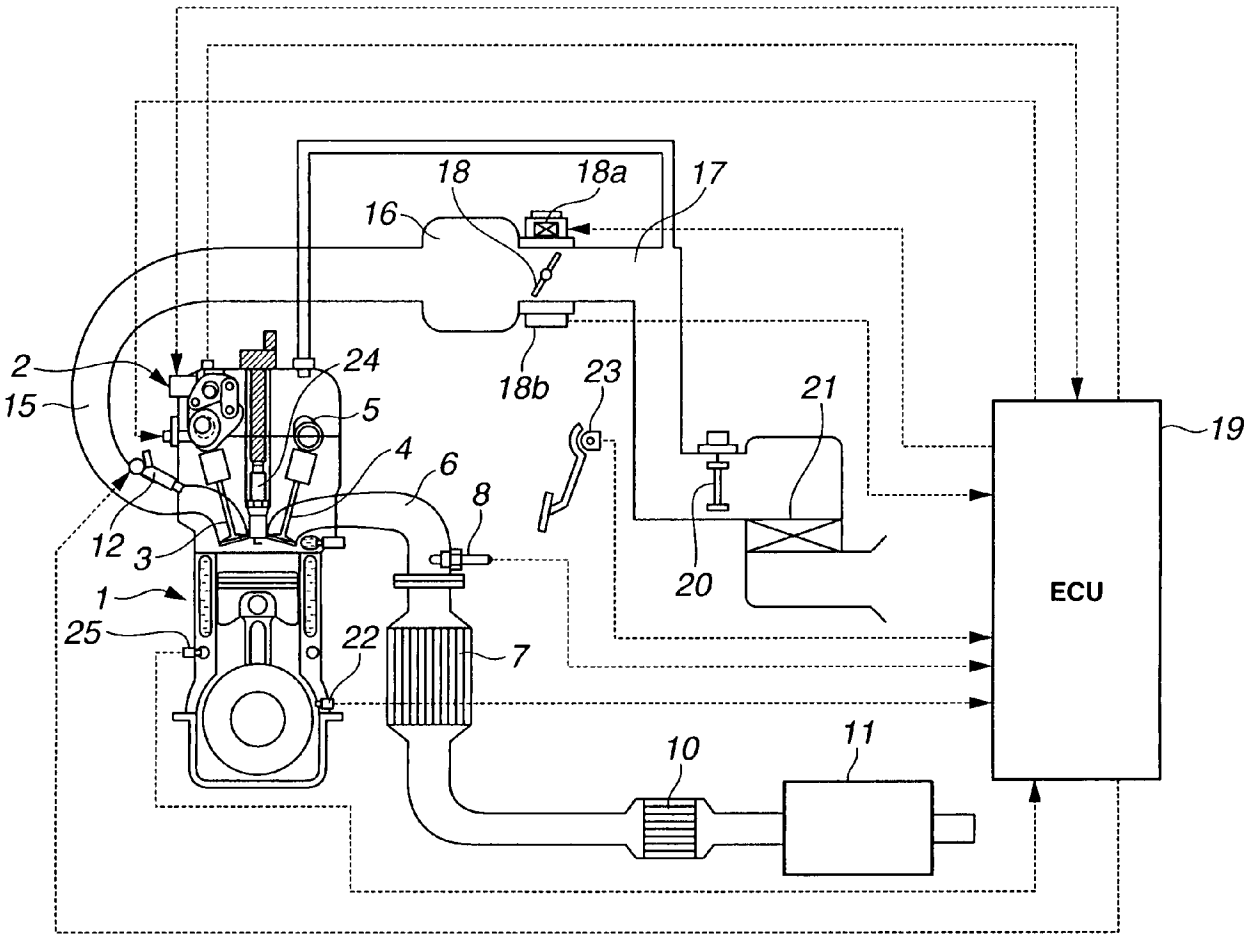
FIG. 1 is a system block diagram depicting an internal combustion engine including a variable valve control system in accordance with an embodiment of the present invention.

Referring now to the drawings, particularly to FIG. 1, the variable valve control system of the embodiment is exemplified in an in-line four-cycle spark-ignited gasoline engine 1 with an intake valve 3 and an exhaust valve 4 in each cylinder. However, the present invention is also applicable to an internal combustion engine with other cylinder arrangement such as a V-type engine, and a six-cylinder or other multi-cylinder engine. As shown in FIG. 1, a variable valve actuation mechanism 2 is provided to actuate intake valves 3 so that an intake-valve lift characteristic is variable as fully described later. On the other hand, a valve actuation mechanism for an exhaust valve 4 of each cylinder bank is constructed as a direct-operated valve actuation mechanism that exhaust valve 4 is driven directly by an exhaust camshaft 5. An exhaust-valve lift characteristic is fixed (constant).

An exhaust manifold 6 is connected to a catalytic converter 7. An air fuel (A/F) ratio sensors (Lambda sensor or oxygen sensor) 8 is provided at the upstream side of catalytic converter 7, for monitoring or detecting the percentage of oxygen contained within the engine exhaust gas, that is, an air/fuel mixture ratio. A second catalytic converter 10 and a muffler 11 are disposed downstream of first catalytic converter 7.

A plurality of intake-manifold branch passages 15 are connected at their downstream ends to the respective intake ports. The upstream ends of the intake-manifold branches 15 are connected to a collector 16. Collector 16 is connected at its upstream end to an intake-air inlet passage 17. An electronically-controlled throttle valve 18 is provided in inlet passage 17. Although it is not clearly shown in the drawing, electronically-controlled throttle valve unit 18 is comprised of a round-disk throttle valve, a throttle position sensor, and a throttle actuator that is driven by means of an electric motor such as a step motor. The throttle actuator adjusts the throttle opening in response to a control command signal from an electronic engine control unit (ECU) 19. The throttle position sensor is provided to monitor or detect the actual throttle opening. As appreciated, in a conventional manner, with an electronic throttle control system having the throttle position sensor, the throttle actuator, and the throttle valve linked to the throttle actuator, the throttle opening can be adjusted or controlled to a desired throttle opening by way of closed-loop control (feedforward control). An air flow sensor 20 is provided upstream of the throttle of electronically-controlled throttle valve unit 18 to measure or detect a quantity of intake air. An air cleaner 21 is further provided upstream of air flow sensor 20.

A crank-angle sensor (or a crankshaft position sensor) 22 is provided to inform the ECU of engine speed as well as the relative position of the engine crankshaft (i.e., a crank angle). A vibration sensor 25 as a sensing section is disposed on the side wall of the cylinder block to measure a physical quantity indicative of an intensity of engine vibration, such as velocity, acceleration, displacement, and their combination. An accelerator opening sensor 23 is provided to monitor or detect an amount of depression of an accelerator pedal depressed by the driver, that is, an accelerator opening. ECU 19 generally comprises a microcomputer. ECU 19 includes an input/output interface (I/O), memories (RAM, ROM), and a microprocessor or a central processing unit (CPU). The input/output interface (I/O) of ECU 19 receives input information from engine/vehicle sensors, namely the throttle position sensor, Lambda sensor 8, crank angle sensor 22, accelerator opening sensor 23, vibration sensor 25, and air flow sensor 20. Within ECU 19, the central processing unit (CPU) allows the access by the I/O interface of input informational data signals from the previously-discussed engine/vehicle sensors. The CPU of ECU 19 is responsible for carrying the fuel-injection/ignition-timing/intake-valve lift characteristic/throttle control program stored in memories and is capable of performing necessary arithmetic and logic operations. Concretely, based on the input information, a fuel-injection amount and a fuel-injection timing of a fuel injection valve or an injector 12 of each engine cylinder are controlled by an electronic fuel-injection control system. An ignition timing of a spark plug 24 of each engine cylinder is controlled by an electronic ignition system. The throttle opening of electronically-controlled throttle valve 18 is controlled by the electronic throttle control system containing the throttle actuator operated responsively to the control command from ECU 19. On the other hand, the intake-valve lift characteristic is electronically controlled by means of variable valve actuation mechanism 2, which is comprised of a variable lift and working-angle control mechanism 51 (a variable lift characteristic control mechanism) and a variable phase control mechanism 52 (described later in detail). Computational results, that is, calculated output signals are relayed through the output interface circuitry of ECU 19 to output stages, namely the throttle actuator included in the electronic throttle control system (the engine output control system), the fuel injectors, the spark plugs, a first actuator for variable lift working-angle control mechanism 51, and a second actuator for variable phase control mechanism 52.

Figure 2:
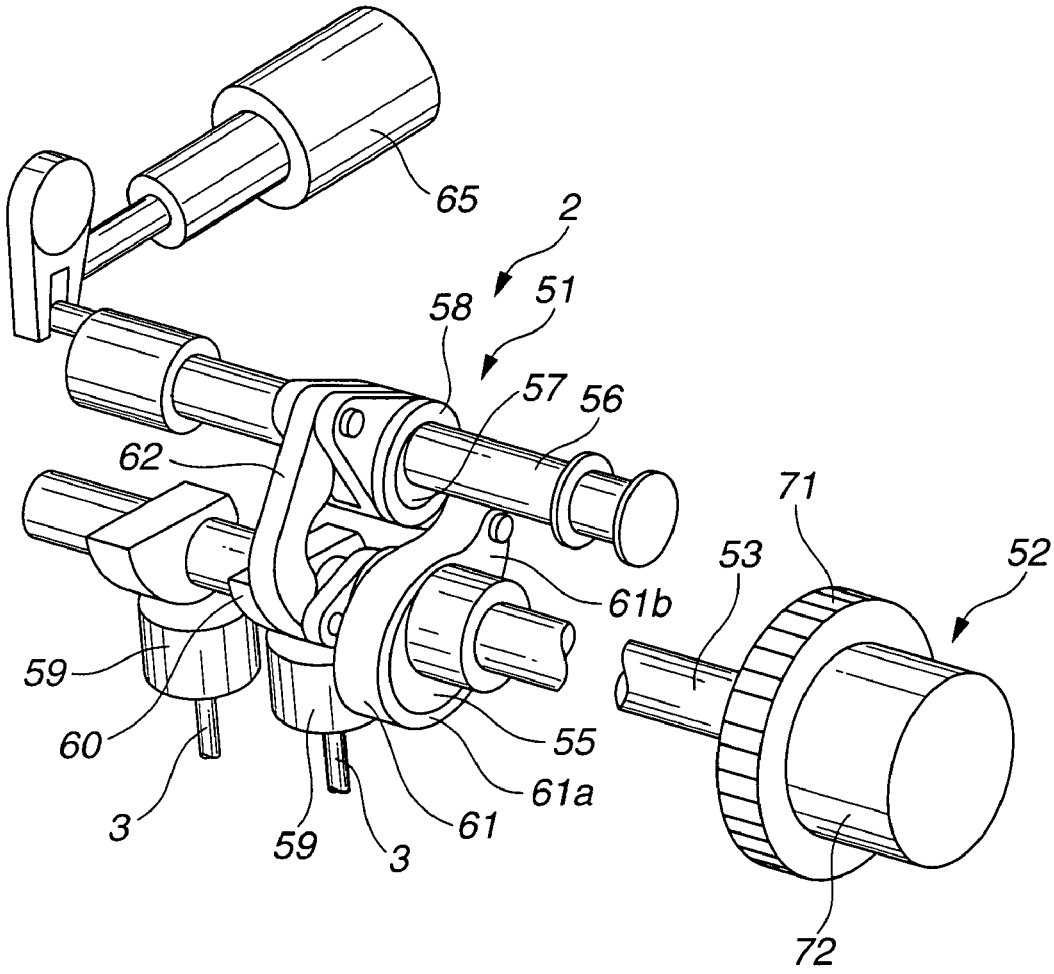
FIG. 2 is a perspective view depicting the detailed construction of the variable valve control system of FIG. 1, which includes a variable working angle control mechanism and a variable phase control mechanism.

Variable valve actuation mechanism 2 is known per se, as disclosed in Japanese Patent Provisional Publication No. 2002-89341. Referring now to FIGS. 2 and 3, there is shown the detailed construction of variable valve actuation mechanism 2. As seen from the perspective view of FIG. 2, variable valve actuation mechanism 2 includes variable lift working-angle control mechanism 51 and variable phase control mechanism 52, combined to each other. Variable lift working-angle control mechanism 51 is provided to continuously adjust a valve lift characteristic of intake valve 3 of each of the cylinders, that is, to continuously change a valve lift and a working angle of intake valve 3 of each of the cylinders. On the other hand, variable phase control mechanism 52 is provided to continuously adjust an intake-valve phase of intake valve 3 of each of the cylinders, that is, to continuously change (advance or retard) an angular phase at the maximum intake-valve lift point, that is, a central-angle phase, with respect to an angular position of the crankshaft.

Variable lift and working-angle control mechanism 51 includes the intake valve slidably installed on the cylinder head, a hollow drive shaft 53 rotatably supported by a cam bracket (not shown) mounted on the upper portion of the cylinder head, a drive eccentric cam 55 press-fitted onto drive shaft 53, a control shaft 56 having an eccentric cam portion 57 whose axis is eccentric to the axis of control shaft 56, which is located above the drive shaft 53, rotatably supported by the same cam bracket, and arranged in parallel with drive shaft 53, a valve rocker arm 58 rockably supported on the eccentric cam portion 57 of control shaft 56, and a rockable cam 60 in sliding-contact with a tappet (a valve lifter) 59 of intake valve 3.

Drive eccentric cam 55 is mechanically linked to valve rocker arm 58 via a link arm 61. Valve rocker arm 58 is mechanically linked to rockable cam 60 via a link member 62. Drive shaft 53 is driven by the engine crankshaft via a timing chain or a timing belt. Drive eccentric cam 55 has a cylindrical outer peripheral surface. The axis of drive eccentric cam 55 is eccentric to the axis of drive shaft 53 by a predetermined eccentricity. The inner periphery of an annular portion 61*a* of link arm 61 is rotatably fitted onto the cylindrical outer periphery of drive eccentric cam 55. The substantially central portion of valve rocker arm 58 is rockably supported by the eccentric cam portion 57 of control shaft 56. One end of valve rocker arm 58 is mechanically linked to or pin-connected to an armed portion 61*b* of link arm 61 via a connecting pin. The other end of valve rocker arm 58 is mechanically linked to or pin-connected to the upper end of link member 62 via a connecting pin. As discussed above, the axis of eccentric cam portion 57 is eccentric to the axis of control shaft 56 by a predetermined eccentricity. Thus, the center of oscillating motion of valve rocker arm 58 changes depending upon the angular position of control shaft 56.

Rockable cam 60 is rotatably fitted onto the outer periphery of drive shaft 53. One end of rockable cam 60, extending in the direction normal to the axis of drive shaft 53, is linked to or pin-connected to the lower end of link member 62 via a connecting pin. Rockable cam 60 is formed on its lower surface with a base-circle surface portion 64*a* being concentric to drive shaft 53 and a moderately-curved cam surface portion 64*b* being continuous with the base-circle surface portion 64*a*. The base-circle portion 64*a* and the cam surface portion 64*b* of rockable cam 60 are designed to be brought into abutted-contact (or sliding-contact) with a designated point of the upper face of tappet 59 of intake valve 3, depending on an angular position of rockable cam 60 oscillating. In this manner, the base-circle surface portion 64*a* serves as a base-circle section within which an intake-valve lift is zero. On the other hand, a predetermined angular range of the cam surface portion 64*b*, being continuous with the base-circle surface portion 64*a*, serves as a ramp section. Additionally, a predetermined angular range of the cam nose portion 60*a* being continuous with the ramp section 64*b*, serves as a lift section.

As shown in FIG. 2, control shaft 56 of variable lift and working-angle control mechanism 51 is actuated within a predetermined angular range by means of a lift and working-angle control actuator 65. In the shown embodiment, variable lift and working-angle control actuator 65 includes a servo motor, to move a protrusion formed in the outer periphery of control shaft 56. The operation of the servo motor of variable lift and working-angle control actuator 65 is electronically controlled in response to a control signal from ECU 19.

During rotation of drive shaft 53, link arm 61 moves up and down by virtue of cam action of drive eccentric cam 55. The up-and-down motion of link arm 61 causes the oscillating motion of valve rocker arm 58. The oscillating motion of valve rocker arm 58 is transmitted via link member 62 to rockable cam 60 with the result that rockable cam 60 oscillates. By virtue of the cam action of rockable cam 60 oscillating, tappet 59 of intake valve 3 is pushed and thus intake valve 3 lifts. When the angular position of control shaft 56 is varied by variable lift and working-angle control actuator 65, an initial position of valve rocker arm 58 varies and as a result an initial position (or a starting point) of the oscillating motion of rockable cam 60 also varies.

Figure 3A:
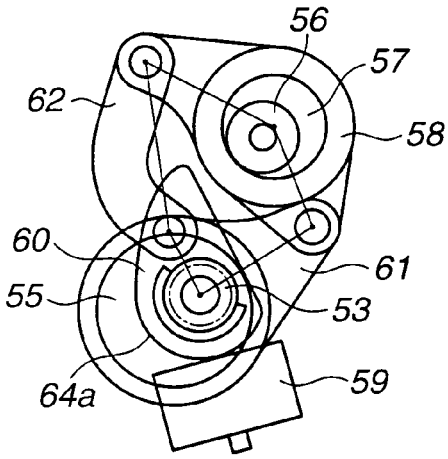
FIG. 3A is a schematic diagram depicting an operating condition of the variable valve control mechanism of FIG. 2 in which the lift of an intake valve is zero, with a rockable cam at the minimum displacement.
Figure 3B:
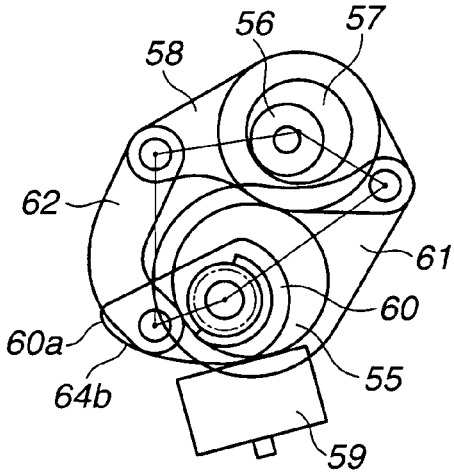
FIG. 3B is a schematic diagram depicting an operating condition of the variable valve control mechanism of FIG. 2 in which the lift of the intake valve is zero, with the rockable cam at the maximum displacement.

As shown in FIGS. 3A and 3B, assuming that the angular position of the eccentric cam portion 57 of control shaft 56 is shifted from a first angular position that the axis of eccentric cam portion 57 is located just under the axis of control shaft 56 to a second angular position that the axis of eccentric cam portion 57 is located just above the axis of control shaft 56, valve rocker arm 58 as a whole shifts upwards. As a result, the end portion 60*a* of rockable cam 60, including a hole for the connecting pin, is relatively pulled upwards. That is, the initial position of rockable cam 60 is shifted such that the rockable cam itself is inclined in a direction that the cam surface portion 64*b* of rockable cam 60 moves apart from intake-valve tappet 59. With valve rocker arm 58 shifted upwards, when rockable cam 60 oscillates during rotation of drive shaft 53, the base-circle surface portion 64*a* of rockable cam 60 is held in contact with tappet 59 for a comparatively long time period. In other words, a time period during which the cam surface portion 64*b* of rockable cam 60 is held in contact with tappet 59 becomes short. As a consequence, a valve lift of intake valve 3 becomes short. Additionally, a working angle (i.e., a lifted period) from intake-valve open timing IVO to intake-valve closure timing IVC becomes reduced.

Figure 3C:
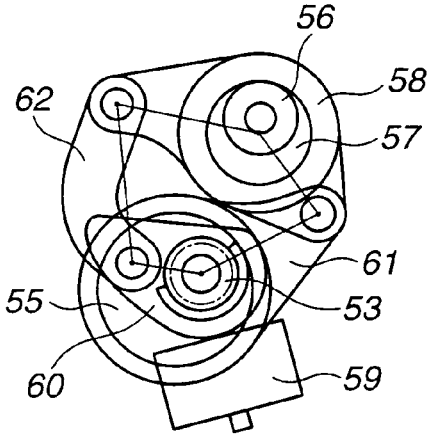
FIG. 3C is a schematic diagram depicting an operating condition of the variable valve control mechanism of FIG. 2 in which the lift of an intake valve is a maximum, with the rockable cam at the minimum displacement.
Figure 3D:
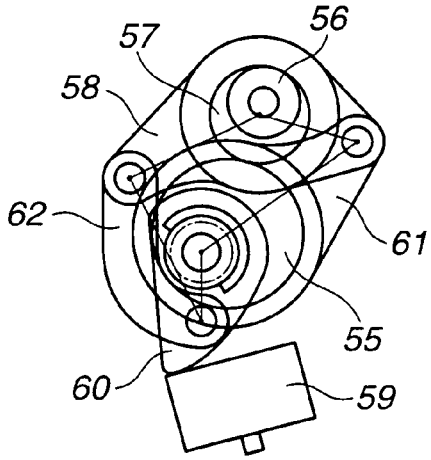
FIG. 3D is a schematic diagram depicting an operating condition of the variable valve control mechanism of FIG. 2 in which the lift of the intake valve is the maximum, with the rockable cam at the maximum displacement.

Conversely, when the angular position of the eccentric cam portion 57 of control shaft 56 is shifted from the second angular position to the first angular position, valve rocker arm 58 as a whole shifts downwards, as shown in FIGS. 3C and 3D. As a result of this, the end portion 60*a* of rockable cam 60, including the hole for the connecting pin, is relatively pulled downwards. That is, the initial position of rockable cam 60 is shifted such that the rockable cam itself is inclined in a direction that the cam surface portion 64*b* of rockable cam 60 moves towards intake-valve tappet 59. With valve rocker arm 58 shifted downwards, when rockable cam 60 oscillates during rotation of drive shaft 53, a portion, which is brought into contact with intake-valve tappet 59, is somewhat shifted from the base-circle surface portion 64*a* of rockable cam 60 to the cam surface portion 64*b* of rockable cam 60. As a consequence, a valve lift of intake valve 3 becomes large. Additionally, the working angle from intake-valve open timing IVO to intake-valve closure timing IVC becomes extended.

Figure 4:
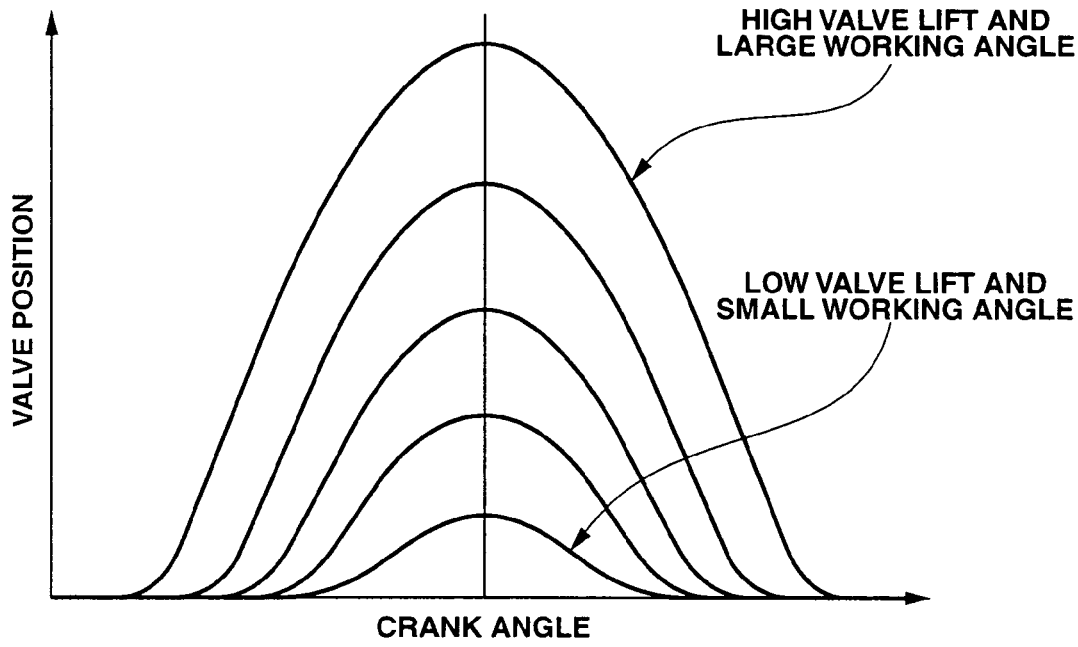
FIG. 4 is a diagram depicting a change in the intake-valve lift and a change in the working angle operated by the variable valve control system of FIG. 1.

The angular position of the eccentric cam portion 57 of control shaft 56 can be continuously varied within limits by means of variable lift and working-angle control actuator 65, and thus the valve lift characteristic (the valve lift and the working angle) also vary continuously, as shown in FIG. 4. That is, variable lift and working-angle control mechanism 51 shown in FIG. 2 can scale up and down both the valve lift and the working angle continuously simultaneously. In other words, in accordance with a change in the valve lift and a change in the working angle, occurring simultaneously, it is possible to vary intake-valve open timing IVO and intake-valve closure timing IVC symmetrically with each other.

Figure 5:
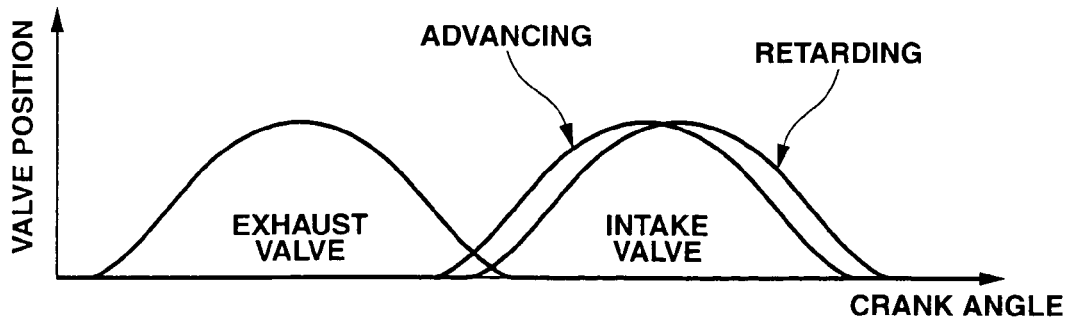
FIG. 5 is a diagram depicting a change in the phase of the intake valve operated by the variable valve control system of FIG. 1.

On the other hand, variable phase control mechanism 52 is comprised of a sprocket 71 and a phase control hydraulic actuator 72. Sprocket 71 is provided at the front end of drive shaft 53. Variable phase control actuator 72 is provided to enable drive shaft 53 to rotate relative to sprocket 71 within a predetermined angular range. Sprocket 71 has a driven connection with the engine crankshaft through a timing chain (not shown) or a timing belt (not shown). Actually, a controlled pressure applied to variable phase control actuator 72 is regulated or modulated by way of a hydraulic control module (not shown), which is responsive to a control signal from ECU 19. The relative rotation of drive shaft 53 to sprocket 71 in one rotational direction results in a phase advance of the central-angle phase at the maximum intake-valve lift point. The relative rotation of drive shaft 53 to sprocket 71 in the opposite rotation direction results in a phase retard of the central-angle phase at the maximum intake-valve lift point. In variable phase control mechanism 52 shown in FIG. 2, only the central-angle phase at the maximum intake-valve lift point is advanced or retarded, with no valve-lift change of intake valve 3 and no working-angle change of intake valve 3, as shown in FIG. 5. The relative angular position of drive shaft 53 to sprocket 71 can be continuously varied within limits by means of variable phase control actuator 72, and thus the central-angle phase also can vary continuously.

As discussed above, variable valve actuation mechanism 2 incorporated in the system of the embodiment is constructed by both of variable lift and working-angle control mechanism 51 and variable phase control mechanism 52 combined to each other. With variable valve actuation mechanism 2, it is possible to widely continuously vary the intake-valve lift characteristic, in particular, to widely continuously vary intake-valve open timing IVO and intake-valve closure timing IVC separately, by way of a combination of the variable lift and working-angle control and the variable phase control. During the engine operating under low-load conditions, the valve lift is reduced to adjust the intake air quantity in accordance with a desired load. The intake air quantity depends mainly on intake-valve open timing IVO and intake-valve closure timing IVC of intake valve 3, with relatively large valve lifts, while the intake air quantity depends mainly on the intake-valve lift, with small valve lifts. In this embodiment, the valve lift characteristic includes two elements of the valve lift and the valve working angle in correlation each other. Accordingly, when the valve lift is relatively large and the valve working angle is also relatively large, the valve lift characteristic is referred to as "large". On the other hand, when the valve lift is relatively small and the valve working angle is also relatively small, the valve lift characteristic is referred to as "small". Alternatively, the size of valve lift characteristic may be the size of one of the valve lift and the valve working angle, the size of a vector including two elements of the valve lift and the valve working angle, or the integration of the valve lift with respect to the valve working angle.

The control of variable lift and working-angle control mechanism 51 and variable phase control mechanism 52 is implemented by a closed-loop control system (feedback control system), or by an open-loop control system (feed-forward control system). More specifically, for example, the variable valve control system may include sensors to detect the valve lift, the working angle, and the central-angle phase of the intake valve to provide a feedback for the closed-loop control system to control variable lift and working-angle control mechanism 51 and variable phase control mechanism 52. Alternatively, the variable valve control system may control variable lift and working-angle control mechanism 51 and variable phase control mechanism 52 by an open-loop control system in accordance with the engine operating condition.

In the above-mentioned system, the intake air quantity is controlled to provide a desired torque determined in accordance with the accelerator opening. The intake-air quantity can be controlled by variably controlling the valve lift characteristic of intake valve 3 by means of variable valve actuation mechanism 2, instead of using the throttle of electronically-controlled throttle valve unit 18. Thus, the throttle opening of electronically-controlled throttle valve unit 18 is usually held at a predetermined constant value at which a predetermined negative pressure in collector 16 can be produced. The predetermined negative pressure in collector 16 is set to a predetermined minimum negative pressure of a negative pressure source, such as −50 mmHg. Fixing the throttle opening of electronically-controlled throttle valve unit 18 to the predetermined constant value corresponding to the predetermined collector pressure (the predetermined minimum negative pressure such as −50 mmHg) means an almost unthrottled condition (in other words, a slightly throttled condition). This greatly reduces a pumping loss of the engine. The predetermined minimum negative pressure (the predetermined vacuum) can be effectively used for recirculation of blowby gas in a blowby-gas recirculation system and/or canister purging in an evaporative emission control system, usually installed on practicable internal combustion engines.

In low load conditions such as the idle conditions, the intake air quantity is controlled to decrease by variable valve actuation mechanism 2. More specifically, variable lift and working-angle control mechanism 51 varies the valve lift of intake valve 3 to a predetermined small valve lift setting, typically to a predetermined minimum valve lift setting, such as 1 mm, to adjust the intake air quantity. If there is variation in the minimum intake-valve lift setting between the cylinders which is cased by manufacturing tolerance of parts and assembly, the variation causes a relatively large variation in the intake air quantity between the cylinders. This causes a large relative variation in air fuel ratio between the cylinders. On the other hand, the quantities of fuel injection into the cylinders are controlled in accordance with a detecting signal from air fuel ratio sensor 8 in exhaust gas, so that the air fuel ratio varies to a target air fuel ratio such as the stoichiometric mixture. Therefore, if there are variation in an actual minimum intake-valve lift setting between the cylinders, the actual air fuel ratios in the cylinders are shifted from the stoichiometric mixture to a rich mixture or a lean mixture. This leads to variation in combustion condition between the cylinders, which results in an increase in the engine vibration, and in a degradation in the exhaust emission.

Accordingly, in the embodiments of the present invention, the variable valve control system is configured to solve the above-mentioned problems caused by the actual relative variation in the valve lift characteristic between the cylinders. Specifically, the variable valve control system is configured to perform determining an engine condition indicator in correlation with an actual relative variation in the valve lift characteristic between the cylinders; determining a desired valve lift characteristic in accordance with an operating condition of the internal combustion engine; controlling the valve lift characteristic of each of the intake valves in accordance with the desired valve lift characteristic; determining the engine condition indicator when the desired valve lift characteristic is equal to a predetermined small valve lift characteristic setting; and expanding the small valve lift characteristic setting if the determined engine condition indicator is larger than a predetermined first threshold value. In this manner, the variable valve control system performs a learning control in which the small valve lift characteristic setting is adjusted and updated. The following describes the detailed construction of the control process of the variable valve control system.

Figure 6:
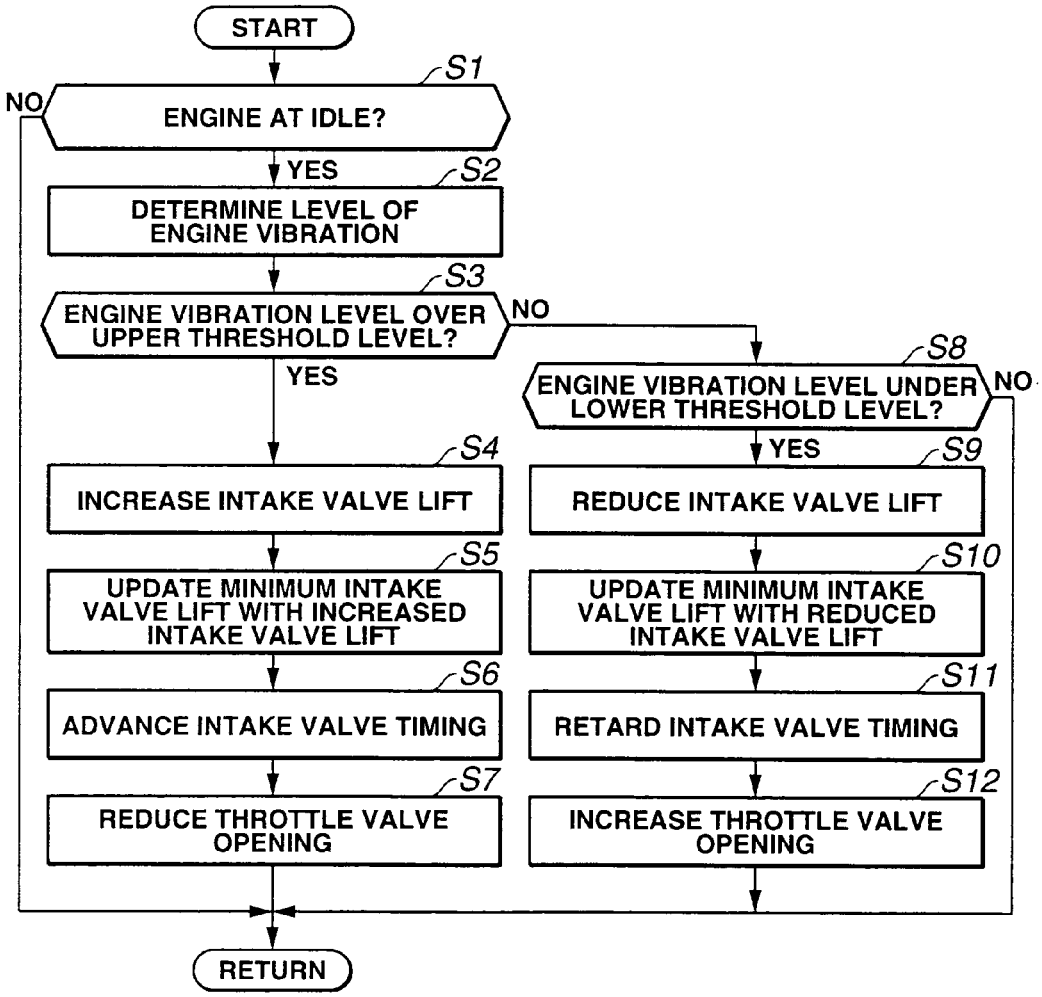
FIG. 6 is a flow chart depicting a process of adjusting a minimum valve lift in accordance with an embodiment of the present invention.

FIG. 6 is a flow chart depicting a process of adjusting the minimum intake-valve lift characteristic setting in accordance with a first embodiment of the present invention. FIGS. 7A through 8D are time charts depicting changes in the throttle opening, the engine speed, the level of engine vibration, and the intake-valve lift during the process in accordance with the routine of FIG. 6. The routine of FIG. 6 is repeatedly executed at intervals of a predetermined short time period such as 10 ms by ECU 19. The following describes the detailed construction of the process of FIG. 6. In normal driving conditions, ECU 19 constantly or repeatedly determines a desired valve lift characteristic in accordance with an operating condition of internal combustion engine 1, and controls the valve lift characteristic of each of intake valves 3 in accordance with the desired valve lift characteristic.

First, at step S1, ECU 19 makes a check to determine whether or not the engine is at idle. During the engine operating at idle, the intake-valve lift characteristic is controlled to be the minimum valve lift characteristic setting by variable lift and working-angle control mechanism 51. For example, in case the vehicle is equipped with an automatic transmission, it is preferable to determine that the engine is at idle when the driving range (D range) is selected and the vehicle is at rest by manual operation of the brake pedal. In other words, ECU 19 makes a check to determine whether or not the engine is in a D-range idle condition in which fuel combustion is stable. Thus, ECU 19 makes a check to determine whether or not the engine is operating in a predetermined idle condition.

When the answer to step S1 is affirmative (YES), the routine proceeds to step S2. At step S2, ECU 19 determines a level of engine vibration. Specifically, ECU 19 receives from vibration sensor 25 a signal of the intensity of engine vibration as an engine condition indicator in correlation with the actual relative variation in the valve lift characteristic between the cylinders, and then determines the engine vibration level in accordance with the information of the signal. Subsequent to step S2, at step S3, ECU 19 makes a check to determine whether or not the engine vibration level is higher than a predetermined upper threshold value Lmax as a predetermined first threshold value. Upper threshold value Lmax is predetermined and fixed to be a maximum value of a range of the engine vibration level in which the engine vibration level produces no effective problem.

When the answer to step S3 is YES, the routine proceeds to step S4. At step S4, ECU 19 expands continuously or by a predetermined small adjustment the intake-valve lift characteristic. Subsequent to step S4, at step S5, ECU 19 updates the minimum intake-valve lift characteristic setting with the expanded intake-valve lift characteristic, and stores it in the memory. The adjusted minimum intake-valve lift characteristic setting is used in the next execution of the routine in low load conditions such as the idle condition. Subsequent to step S5, at step S6, ECU 19 advances the central-angle phase by a predetermined adjustment by means of variable phase control mechanism 52, so that intake-valve closure timing IVC is held substantially constant to cancel an undue delay in intake-valve closure timing IVC caused by the increase in the intake valve working angle through step S4. Subsequent to step S6, at step S7, ECU 19 reduces the throttle opening by a predetermined adjustment, so that the intake air quantity is held substantially constant to cancel the increase in the intake air quantity caused by the expansion of the intake-valve lift characteristic. After step S7 is executed, the routine returns. The above-mentioned series of steps is repeatedly executed at intervals of a short time period. Accordingly, steps S4 through S7 are repeatedly executed during the level of engine vibration being higher than upper threshold value Lmax, so that the minimum valve lift characteristic setting expands continuously or gradually by the predetermined adjustment (indicated by F1 in FIG. 7D), that the central-angle phase advances gradually, and that the throttle opening decreases gradually (indicated by F2 in FIG. 7A), as shown in FIGS. 7A through 7D.

When the answer to step S3 is negative (NO), the routine proceeds to step S8. At step S8, ECU 19 makes a check to determine whether or not the level of engine vibration is lower than a predetermined lower threshold value Lmin as a predetermined second threshold value. Lower threshold value Lmin is predetermined as a value smaller than upper threshold value Lmax. A predetermined difference between lower threshold value Lmin and upper threshold value Lmax functions as a hysteresis to prevent undue frequently repeated execution of adjusting the minimum intake-valve lift characteristic setting. Alternatively, lower threshold value Lmin and upper threshold value Lmax may be equal to a same value. When the answer to step S8 is YES, the routine proceeds to step S9. At step S9, ECU 19 contracts by a predetermined adjustment the intake-valve lift characteristic. Subsequent to step S9, at step S10, ECU 19 updates the minimum intake-valve lift characteristic setting with the contracted intake-valve lift characteristic, and stores it in the memory. The adjusted minimum intake-valve lift characteristic setting is used in the next execution of the routine in the low load condition such as the idle condition. Subsequent to step S10, at step S11, ECU 19 retards the central-angle phase by a predetermined adjustment by operating variable phase control mechanism 52, so that intake-valve closure timing IVC is held substantially constant to cancel an undue advance in intake-valve closure timing IVC caused by the contraction in the intake-valve lift characteristic through step S9. Subsequent to step S11, at step S12, ECU 19 increases the throttle opening by a predetermined adjustment, so that the intake air quantity is held substantially constant to cancel the decrease in the intake air quantity caused by the contraction in the intake-valve lift characteristic. After step S12 is executed, the routine returns. The above-mentioned series of steps is repeatedly executed at intervals of a short time period. Accordingly, steps S9 through S12 are repeatedly executed during the level of engine vibration being lower than lower threshold value Lmin, so that the minimum valve lift deceases gradually by the predetermined adjustment (indicated by F3 in FIG. 8D), that the central-angle phase retards gradually, and that the throttle opening increases gradually (indicated by F4 in FIG. 8A), as shown in FIGS. 8A through 8D. When the answer to step S8 is NO, the routine returns.

In accordance with the above-mentioned process, when the level of engine vibration caused by the valve lift variation between the cylinders exceeds upper threshold value Lmax so that the engine vibration or the variation in the intake air quantity is considered as a trouble, the routine proceeds to step S4, at which the minimum intake-valve lift characteristic setting is expanded repeatedly by the small adjustment. Accordingly, the minimum intake-valve lift characteristic setting contracts gradually. The expansion in the minimum intake-valve lift characteristic setting reduces the valve lift variation between the cylinders, so that the level of engine vibration decreases gradually, as shown in FIGS. 7A through 7D. When the level of engine vibration decreases below upper threshold value Lmax, the condition of step S3 is unsatisfied, so that the adjustment process of expanding the minimum intake-valve lift characteristic setting is terminated. The minimum intake-valve lift characteristic setting is updated with a new one, and is stored in the memory to be used in the next process or later. Therefore, the control process in accordance with the above-mentioned embodiment immediately reduces the engine vibration and the variation in the intake air quantity between the cylinders which are caused by the valve lift variation between the cylinders.

As discussed above, during the engine being at idle, the intake air quantity is controlled to decrease by contracting the intake-valve lift characteristic of variable lift and working-angle control mechanism 51. In parallel with this valve control, the throttle opening is increased so that the negative pressure in the manifold decreases to reduce the pumping loss of the engine. The reduction of the pumping loss provides a lot of merits, namely, improves the fuel economy, and enhances the responsiveness of acceleration from the idle condition because of the reduction of a time period during which the intake manifold is charged with air. As a matter of course, the minimum intake-valve lift characteristic setting is set to be as small as possible. In the shown embodiment, the adjustment of the minimum intake-valve lift characteristic setting is implemented by gradually increasing the minimum intake-valve lift characteristic setting by a predetermined small adjustment, preventing an excessive increase or an overshoot in the minimum intake-valve lift characteristic setting.

The adjustment process of FIG. 6 is executed during ordinary uses of the engine. On the other hand, an initial setting operation of the minimum intake-valve lift characteristic setting is performed, for example, in a factory before shipping. In this initial setting operation, the minimum intake-valve lift characteristic setting is determined so as to reduce the relative variation in the intake-valve lift between the cylinders which is cased by manufacturing tolerance of parts and assembly. This initially determined minimum intake-valve lift characteristic setting under which the intake-valve lift is never regulated is stored in ROM and not rewritten. In the adjustment process of FIG. 6 during the engine operating, the minimum intake-valve lift characteristic setting is adjusted in the increasing direction or decreasing direction in a range over the initial minimum intake-valve lift characteristic setting, to absorb secular changes including wear of parts and adherence of deposit around the valve train. Therefore, the minimum intake-valve lift characteristic setting is constantly updated, so as to achieve a high level of balance between the reduction of the pumping loss and the reduction of the relative valve lift variation between the cylinders.

In variable lift and working-angle control mechanism 51, intake-valve open timing IVO and intake-valve closure timing IVC vary with varying intake-valve characteristic or varying intake-valve lift. For example, intake-valve closure timing IVC retards with expanding intake-valve lift characteristic, while intake-valve closure timing IVC advances with contracting intake-valve lift characteristic. In the shown embodiment, the central-angle phase is temporarily adjusted by variable phase control mechanism 52 at step S6 or S11, so as to cancel an undue change in intake-valve closure timing IVC during the process of adjusting the minimum intake-valve lift characteristic setting. In addition, the throttle opening is temporarily adjusted at step S7 or S12, so as to cancel an undue change in the intake air quantity during the process of adjusting the minimum intake-valve lift characteristic setting. Thus, the operating condition of the engine is held stable during the process of adjusting the minimum intake-valve lift characteristic setting.

When the vehicle is traveling at deceleration with no fuel supply, that is, when the engine is operating with deceleration fuel cutoff, the intake-valve lift is set to the minimum intake-valve lift characteristic setting or a setting smaller than the minimum intake-valve lift characteristic setting, such as a setting which is determined by a mechanical stop mechanism to limit the rotation of control shaft 56, so that the intake air quantity and the engine speed decrease as soon as possible. In the above-mentioned condition in which the vehicle is traveling at deceleration with no fuel supply, the engine vibration caused by the relative valve lift variation between the cylinders is of less importance, and it is preferable that the intake-valve lift is as short as possible. In the shown embodiment, it is checked whether the engine is at idle, at step S1. When this condition of step S1 is unsatisfied, the minimum intake-valve lift characteristic setting is not adjusted. In other words, the adjustment of the minimum intake-valve lift characteristic setting is inhibited during internal combustion engine 1 operating with fuel cutoff. Therefore, during the vehicle traveling at deceleration with no fuel supply, the intake-valve lift is reduced as small as possible.

Figure 9:
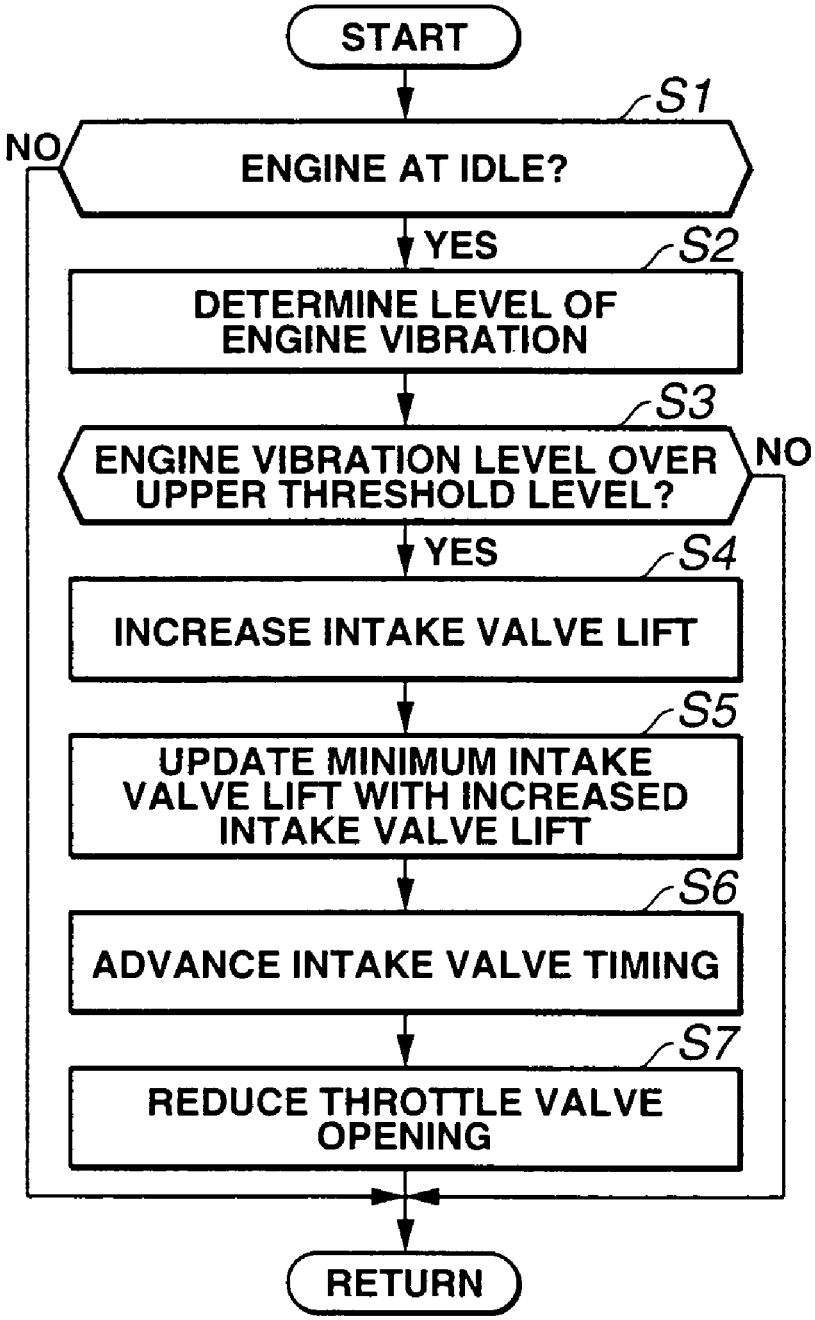
FIG. 9 is a flow chart depicting a process of adjusting a minimum valve lift in accordance with another embodiment of the present invention.
Figures 10A, 10B, 10C, 10D:
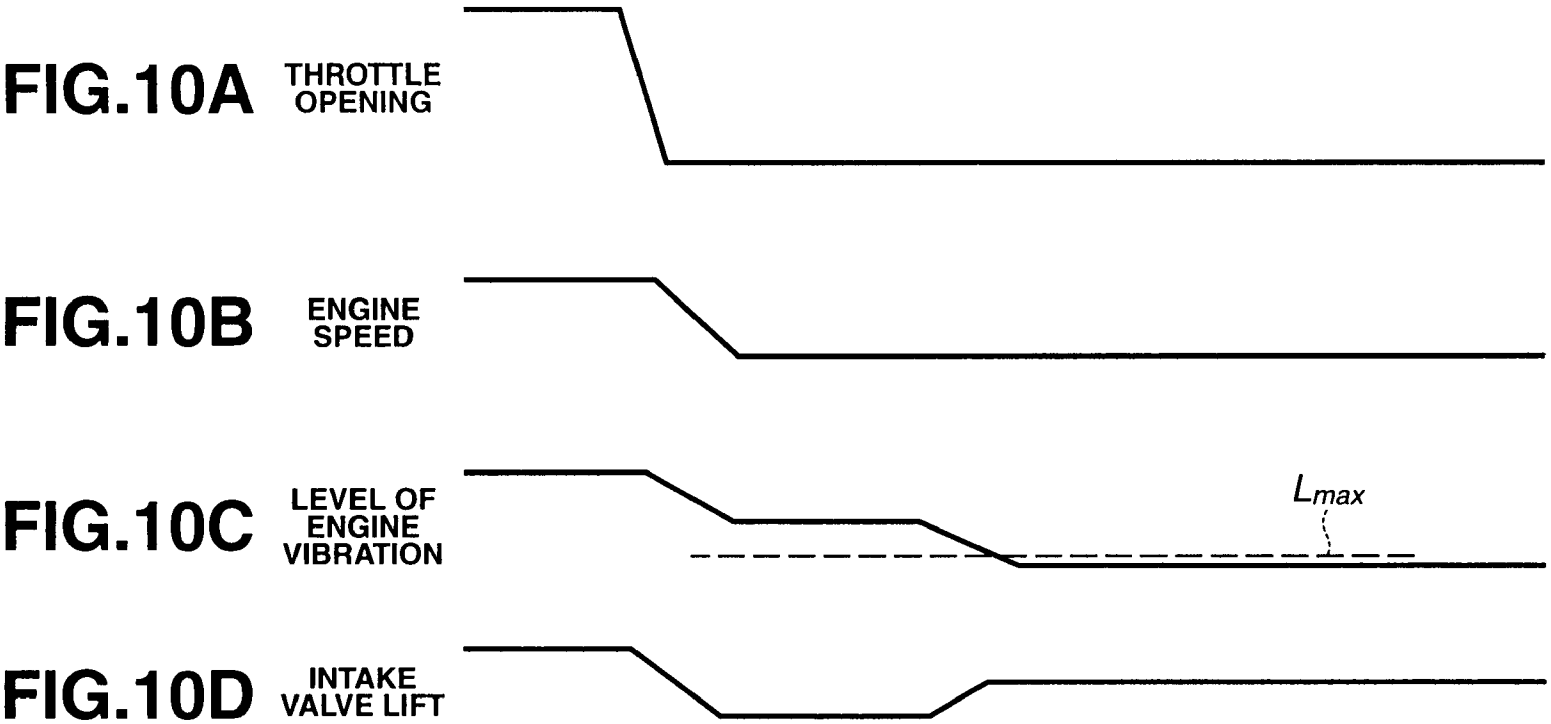
FIG. 10A is a time chart depicting a change in the throttle opening in the process of FIG. 9.
FIG. 10B is a time chart depicting a change in the engine speed in the process of FIG. 9.
FIG. 10C is a time chart depicting a change in the level of engine vibration in the process of FIG. 9.
FIG. 10D is a time chart depicting a change in the intake-valve lift in the process of FIG. 9.

FIG. 9 is a flow chart depicting a process of adjusting the minimum valve lift characteristic setting in accordance with a second embodiment of the present invention. FIGS. 10A through 10D are time charts depicting changes in the throttle opening, the engine speed, the level of engine vibration, and the intake-valve lift, during the process of FIG. 9. The control process of this second embodiment is constructed by deleting steps S8 through S12 from the control process of the first embodiment. More specifically, the operation of reducing the minimum intake-valve lift characteristic setting which is executed in case the level of engine vibration is lower than lower threshold value Lmin is deleted. In this embodiment, when the level of engine vibration indicative of the valve lift variation between the cylinders is higher than upper threshold value Lmax, the routine proceeds from step S3 to step S4, at which the minimum intake-valve lift characteristic setting is expanded. Therefore, as in the first embodiment, the control process in accordance with the above-mentioned embodiment reduces the engine vibration and the variation in the intake air quantity between the cylinders which are caused by the valve lift variation between the cylinders.

Although the present invention has been described above by reference to certain embodiments of the invention, the invention is not limited to the embodiments described above. In the above-mentioned embodiments, the variable valve control system uses the level or intensity of engine vibration which is detected by vibration sensor 25, as a condition indicator indicative of the valve lift variation between the cylinders. Alternatively, a variation in the intake air quantity between the cylinders may be used as the condition indicator. In this alternative case, the variation in the intake air quantity between the cylinders is determined based on information of the intake air quantity from air flow sensor 20 or a boost pressure sensor. Alternatively, a variation in incylinder pressure between the cylinders may be used as the condition indicator. In this alternative case, the incylinder pressure may be directly detected by an incylinder pressure sensor, or may be simply estimated based on the change in the rotational speed of the crankshaft determined based on a signal from crank angle sensor 22. Alternatively, a knock sensor may be used to determine the engine vibration. Alternatively, a lift sensor may be used to directly determine the intake-valve lift. In this alternative case, an indicator of cylinder-to-cylinder variation in the intake-valve lift may be determined by statistical calculation, for example, to be a maximum relative difference in the intake-valve lift among the cylinders, or a relative dispersion in the intake-valve lift among the cylinders.

In the above-mentioned embodiments, variable lift and working-angle control mechanism 51 is provided to continuously vary the valve lift and the working angle of the intake valve. Alternatively, instead of variable lift and working-angle control mechanism 51, the variable valve control system may employ another mechanism such as a mechanism including a three-dimensional cam supported on the camshaft, whose profile is designed and formed so as to continuously vary the lift and the working angle in accordance with axial motion of the camshaft.

In the above-mentioned embodiments, the variable valve control system adjusts the minimum intake-valve lift characteristic setting. If a predetermined idle setting slightly larger than the minimum intake-valve lift characteristic setting is employed in the idle conditions of the engine, the variable valve control system may adjust the predetermined idle setting, instead of the minimum intake-valve lift characteristic setting. In this alternative case, the level of engine vibration resulting from the variation in the intake-valve lift between the cylinders is held below the threshold value during the intake-valve lift characteristic being larger than the predetermined idle setting.

In the above-mentioned embodiments, the variable valve control system adjusts the intake-valve characteristic, updates the minimum intake-valve lift characteristic setting with the adjusted intake-valve characteristic, so that the variable valve control system may employ the updated minimum intake-valve lift characteristic setting in the next idle conditions or in the next adjustment process. Alternatively, the intake-valve lift characteristic may be temporarily adjusted only for the current engine operation as occasion demands.

Drive shaft 53 and rockable cam 60 of variable lift and working-angle control mechanism 51 can be located in a substantially same position in an engine as a camshaft and a fixed cam of a typical direct-acting valve train. In addition, the constituent elements of variable lift and working-angle control mechanism 51 can be gathered and disposed near around drive shaft 53. Accordingly, variable lift and working-angle control mechanism 51 is constructed to be compact to be easily mounted on an engine. Variable lift and working-angle control mechanism 51 can be mounted on a conventional engine by adding small design change to the engine. In variable lift and working-angle control mechanism 51, most of the connection points between the link elements, such as the bearing between control eccentric cam 57 and valve rocker arm 58, are in face-to-face contact. In addition, variable lift and working-angle control mechanism 51 needs no element for biasing two elements toward each other such as a return spring. Accordingly, variable lift and working-angle control mechanism 51 is easily lubricated, resulting in enhancement in durability and in reliability.

As discussed above, the variable valve control system reduces the relative variation in the intake-valve lift characteristic between the cylinders, to prevent problems caused by the relative variation in the intake-valve lift characteristic between the cylinders, that is, to prevent an increase in engine vibration, a decrease in the stability of combustion, and an increase in pollutants in exhaust emission, and to improve fuel economy. Thus, the variable valve control system is capable of continuously varying the valve lift characteristic in a wide range without no problem resulting from the variation in the valve lift characteristic among the cylinders.

This application is based on a prior Japanese Patent Application No. 2004-50976 filed on Feb. 26, 2004. The entire contents of this Japanese Patent Application No. 2004-50976 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable valve control system for an internal combustion engine including a plurality of cylinders and a plurality of intake valves each for an associated one of the cylinders, the variable valve control system comprising:

a variable lift characteristic control mechanism to adjust a valve lift characteristic of each of the intake valves;

a sensing section to collect information needed to determine an engine condition indicator in correlation with an actual relative variation in the valve lift characteristic between the cylinders; and a control unit in operative communication with the variable lift characteristic control mechanism and the sensing section, to perform the following:

determining a desired valve lift characteristic in accordance with an operating condition of the internal combustion engine;

controlling the valve lift characteristic of each of the intake valves in accordance with the desired valve lift characteristic;

determining the engine condition indicator when the desired valve lift characteristic is equal to a predetermined small valve lift characteristic setting; and expanding the small valve lift characteristic setting if the determined engine condition indicator is larger than a predetermined first threshold value.

2. The variable valve control system as claimed in claim 1, wherein the variable lift characteristic control mechanism is configured to continuously adjust the valve lift characteristic of each of the intake valves, and the small valve lift characteristic setting is continuously variable.

3. The variable valve control system as claimed in claim 1, wherein the valve lift characteristic includes at least one element of a valve lift and a working angle in correlation with each other.

4. The variable valve control system as claimed in claim 1, further comprising a variable phase control mechanism to adjust a phase of each of the intake valves, wherein the control unit is configured to perform the following:

advancing the phase of each of the intake valves to cancel a change in an intake-valve closure timing of each of the intake valves which is caused by the operation of expanding the small valve lift characteristic setting.

5. The variable valve control system as claimed in claim 1, for the internal combustion engine including a throttle valve, wherein the control unit is configured to perform the following:

reducing a throttle opening of the throttle valve to cancel a change in a quantity of intake air into the internal combustion engine which is caused by the operation of expanding the small valve lift characteristic setting.

6. The variable valve control system as claimed in claim 1, wherein the control unit is configured to perform the following:

inhibiting the operation of expanding the small valve lift characteristic setting during the internal combustion engine operating with fuel cutoff.

7. The variable valve control system as claimed in claim 1, wherein the control unit is configured to perform the following:

contracting the small valve lift characteristic setting if the determined engine condition indicator is smaller than a predetermined second threshold value which is smaller than or equal to the first threshold value.

8. The variable valve control system as claimed in claim 1, further comprising a variable phase control mechanism to adjust a phase of each of the intake valves, wherein the control unit is configured to perform the following:

retarding the phase of each of the intake valves to cancel a change in an intake-valve closure timing of each of the intake valves which is caused by the operation of contracting the small valve lift characteristic setting.

9. The variable valve control system as claimed in claim 1, wherein the sensing section comprising a vibration sensor to measure a physical quantity indicative of an intensity of engine vibration which is used to determine the engine condition indicator.

10. The variable valve control system as claimed in claim 1, wherein the sensing section comprising an air flow sensor to measure a quantity of intake air into each of the cylinders which is used to determine an actual relative variation in the quantity of intake air between the cylinders as the engine condition indicator.

11. The variable valve control system as claimed in claim 1, wherein the sensing section comprising a boost pressure sensor to measure a boost pressure for each of the cylinders which is used to determine an actual relative variation in the quantity of intake air between the cylinders as the engine condition indicator.

12. The variable valve control system as claimed in claim 1, wherein the sensing section comprising an incylinder sensor to measure an incylinder pressure of each of the cylinders which is used to determine an actual relative variation in the incylinder pressure between the cylinders as the engine condition indicator.

13. The variable valve control system as claimed in claim 1, wherein the sensing section comprising a crank angle sensor to measure a crank angle which is used to determine an actual relative variation in an incylinder pressure between the cylinders as the engine condition indicator.

14. The variable valve control system as claimed in claim 1, wherein the sensing section comprising a knock sensor to measure a physical quantity indicative of an intensity of engine vibration used to determine the engine condition indicator.

15. The variable valve control system as claimed in claim 1, wherein the control unit is configured to perform the following:

the operation of determining the desired valve lift characteristic is implemented by determining the desired valve lift characteristic to be larger than or equal to the small intake valve characteristic setting in accordance with an operating condition of the internal combustion engine.

16. The variable valve control system as claimed in claim 1, wherein the small intake valve characteristic setting is a minimum contracted intake valve characteristic of a region of the intake valve characteristic of each of the intake valves in which it is desired that the engine condition indicator is held smaller than the first threshold value.

17. The variable valve control system as claimed in claim 1, wherein the variable lift characteristic control mechanism comprising:

a drive shaft driven by a crankshaft of the internal combustion engine;

a drive eccentric cam including an axis eccentric to an axis of the drive shaft;

a control shaft including an axis in parallel with the axis of the drive shaft;

a control eccentric cam including an axis eccentric to the axis of the control shaft;

a valve rocker arm rockably supported on the control eccentric cam;

a rockable cam in contact with each of the intake valve;

a link member mechanically linking one end portion of the valve rocker arm and the rockable cam; and a link arm mechanically linking another end portion of the valve rocker arm and the drive eccentric cam.

18. The variable valve control system as claimed in claim 1, wherein the control unit is configured to perform the following:

determining the desired valve lift characteristic to be the small valve lift characteristic setting in a predetermined operating condition of the internal combustion engine.

19. The variable valve control system as claimed in claim 18, wherein the control unit is configured to perform the following:

determining the desired valve lift characteristic to be the small valve lift characteristic setting during the internal combustion engine operating at idle.

20. A variable valve control system for an internal combustion engine including a plurality of cylinders and a plurality of intake valves each for an associated one of the cylinders, the variable valve control system comprising:

variable lift characteristic control means for adjusting a valve lift characteristic of each of the intake valves;

sensing means for collecting information needed to determine an engine condition indicator in correlation with an actual relative variation in the valve lift characteristic between the cylinders; and control means in operative communication with the variable lift characteristic control means and the sensing means for performing the following:

determining a desired valve lift characteristic in accordance with an operating condition of the internal combustion engine;

controlling the valve lift characteristic of each of the intake valves in accordance with the desired valve lift characteristic;

determining the engine condition indicator when the desired valve lift characteristic is equal to a predetermined small valve lift characteristic setting; and expanding the small valve lift characteristic setting if the determined engine condition indicator is larger than a predetermined first threshold value.

21. A method of controlling a variable valve control system for an internal combustion engine including a plurality of cylinders and a plurality of intake valves each for an associated one of the cylinders, the variable valve control system including a variable lift characteristic control mechanism to adjust a valve lift characteristic of each of the intake valves, the method comprising:

determining an engine condition indicator in correlation with an actual relative variation in the valve lift characteristic between the cylinders;

determining a desired valve lift characteristic in accordance with an operating condition of the internal combustion engine;

controlling the valve lift characteristic of each of the intake valves in accordance with the desired valve lift characteristic;

determining the engine condition indicator when the desired valve lift characteristic is equal to a predetermined small valve lift characteristic setting; and expanding the small valve lift characteristic setting if the determined engine condition indicator is larger than a predetermined first threshold value.

* * * * *